US011565517B2

(12) United States Patent
Sato et al.

(10) Patent No.: US 11,565,517 B2
(45) Date of Patent: Jan. 31, 2023

(54) INFORMATION PROCESSING DEVICE, LEARNING DEVICE, AND INFORMATION PROCESSING METHOD

(71) Applicant: SEIKO EPSON CORPORATION, Tokyo (JP)

(72) Inventors: Katsuaki Sato, Matsumoto (JP); Kazunaga Suzuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 204 days.

(21) Appl. No.: 17/061,072

(22) Filed: Oct. 1, 2020

(65) Prior Publication Data

US 2021/0101384 A1 Apr. 8, 2021

(30) Foreign Application Priority Data

Oct. 2, 2019 (JP) ..... JP2019-181961

(51) Int. Cl.
*B41J 29/38* (2006.01)
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/175; B41J 29/38
See application file for complete search history.

(56) References Cited

U.S. PATENT DOCUMENTS 6,450,625 B1 * 9/2002 Fujii ..... B41J 2/1646 347/70
2008/0012893 A1 * 1/2008 Sakakitani ..... B41J 2/17509 347/19
2012/0024395 A1 * 2/2012 Furukawa ..... B41J 29/38 222/23
2016/0339708 A1 11/2016 Genta et al.

FOREIGN PATENT DOCUMENTS

JP 2016-215478 A 12/2016

* cited by examiner

*Primary Examiner* — Lam S Nguyen
(74) *Attorney, Agent, or Firm* — Workman Nydegger

(57) ABSTRACT

An information processing device includes a storage portion storing a learned model, a reception portion receiving air pressure information and temperature information at a time of ejecting ink, and a processing portion controlling a pressurization pump based on the received air pressure information and temperature information and the learned model. The learned model is a learned model trained by performing machine learning of a condition of a pressurization force with which a determination that an ejection failure does not occur is made, based on a data set in which the air pressure information in a usage environment of a printing apparatus including a printing head, the temperature information in the usage environment, and pressurization force information about the pressurization pump supplying the ink to the printing head are associated.

11 Claims, 11 Drawing Sheets

INFORMATION PROCESSING DEVICE, LEARNING DEVICE, AND INFORMATION PROCESSING METHOD

The present application is based on, and claims priority from JP Application Serial Number 2019-181961, filed Oct. 2, 2019, the disclosure of which is hereby incorporated by reference herein in its entirety.

BACKGROUND

1. Technical Field

The present disclosure relates to an information processing device, a learning device, and an information processing method.

2. Related Art

In a printing apparatus, it is known that an ejection failure occurs due to an air pressure of an environment in which the printing apparatus is used. For example, in a region in which the air pressure is low, a difference between a negative pressure in a flow passage and a printing head and an atmospheric pressure is small, and the amount of ink supplied to the head is reduced. Thus, an ejection failure may occur. JP-A-2016-215478 discloses a method of controlling a suction operation in accordance with an air pressure in a printing apparatus performing the suction operation by forming a negative pressure inside a cap covering an ejection port surface of a printing head.

JP-A-2016-215478 does not consider ink supply using pressurization. In addition, information other than the air pressure is not considered in a pressure control for ink supply. For example, in the method of the related art, a change in viscosity of ink corresponding to temperature is not considered.

SUMMARY

According to an aspect of the present disclosure, there is provided an information processing device including a storage portion storing a learned model trained by performing machine learning of a condition of a pressurization force with which a determination that an ejection failure does not occur is made, based on a data set in which air pressure information in a usage environment of a printing apparatus including a printing head, temperature information in the usage environment, and pressurization force information about a pressurization pump supplying ink to the printing head are associated, a reception portion receiving the air pressure information and the temperature information at a time of ejecting the ink, and a processing portion controlling the pressurization pump based on the received air pressure information and temperature information and the learned model.

DESCRIPTION OF EXEMPLARY EMBODIMENTS

Hereinafter, the present embodiment will be described. The present embodiment described below does not unduly limit a content disclosed in the claims. Not all configurations described in the present embodiment are essential constituents.

1. Overview

1.1 Configuration Example of Printing Apparatus

Figure 1:
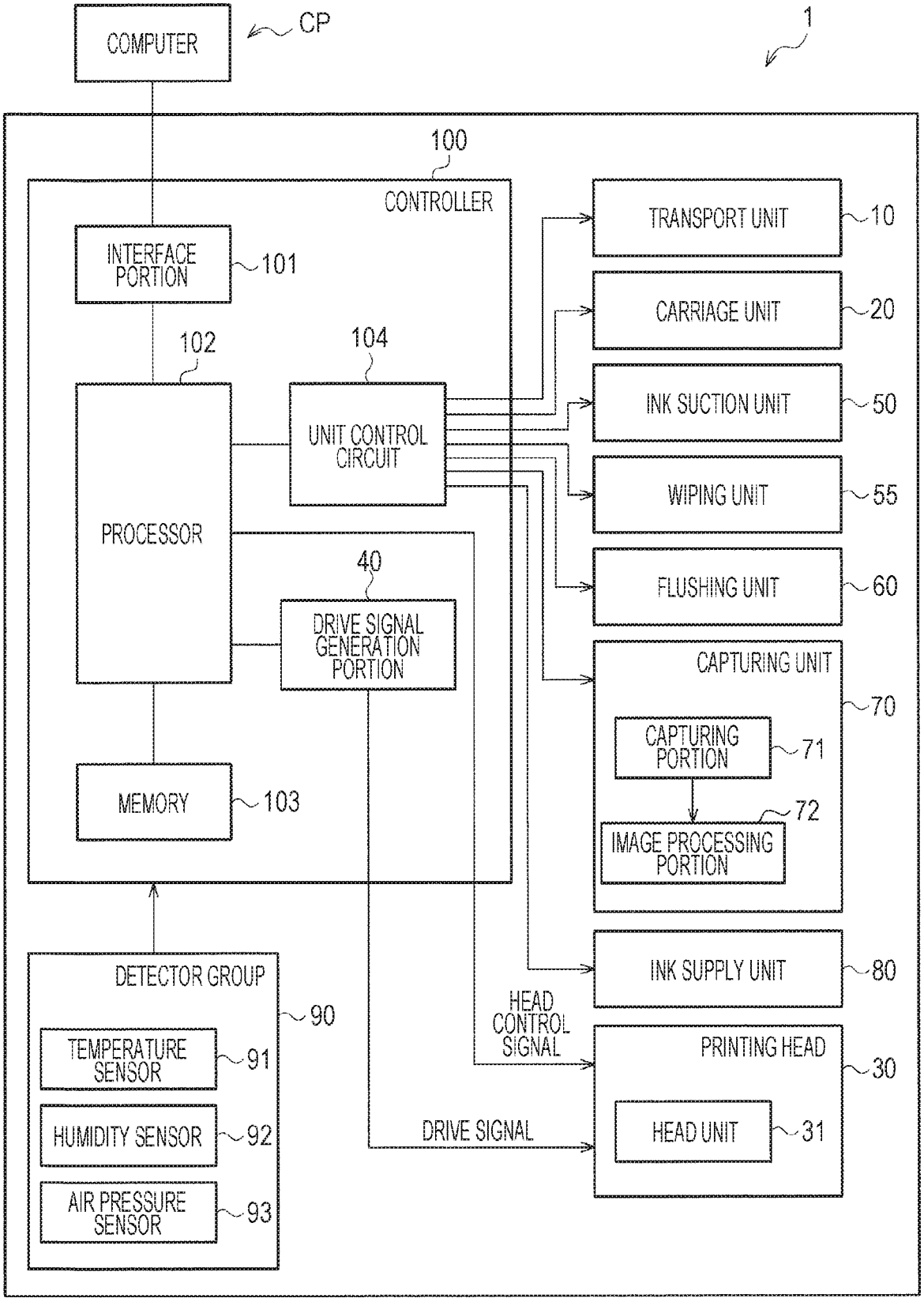
FIG. 1 is a configuration example of a printing apparatus.

FIG. 1 is a diagram illustrating a configuration of a printing apparatus 1 according to the present embodiment. As illustrated in FIG. 1, the printing apparatus 1 includes a transport unit 10, a carriage unit 20, a printing head 30, a drive signal generation portion 40, an ink suction unit 50, a wiping unit 55, a flushing unit 60, a capturing unit 70, an ink supply unit 80, a detector group 90, and a controller 100. The printing apparatus 1 ejects ink toward a printing medium and is communicably connected to a computer CP. In order to cause the printing apparatus 1 to print an image, the computer CP transmits printing data corresponding to the image to the printing apparatus 1. The printing data includes printing image data representing the image and printing setting information. The printing setting information is information for deciding the size of the printing medium, printing quality, color setting, and the like.

Figure 2:
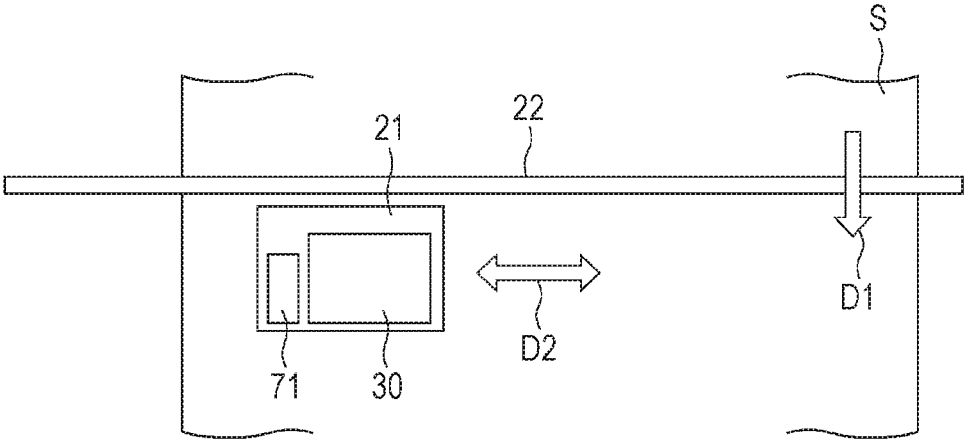
FIG. 2 is a diagram illustrating a configuration around a printing head.

FIG. 2 is a diagram for describing a configuration around the printing head 30. The printing medium is transported in a predetermined direction by the transport unit 10. For example, the printing medium is a paper sheet S. The paper sheet S may be a printing paper sheet having a predetermined size or continuous paper. The printing medium is not limited to paper, and various media such as cloth, a film, and polyvinyl chloride (PVC) can be used. Hereinafter, the direction in which the printing medium is transported will be referred to as the transport direction. The transport direction corresponds to D1 in FIG. 2. The transport unit 10 includes a transport roller, a transport motor, and the like not illustrated. The transport motor rotates the transport roller. By rotating the transport roller, the printing medium that is fed is transported to a printing area that is a region in which printing processing can be executed. The printing area is a region that can face the printing head 30.

The printing head 30 is mounted in the carriage unit 20. The carriage unit 20 includes a carriage 21 and a carriage motor not illustrated. The carriage 21 is supported in a reciprocable manner in a paper width direction of the paper sheet S along a guide rail 22. The carriage motor is driven based on a carriage control signal from a processor 102. By driving the carriage motor, the carriage 21 is moved together with the printing head 30 as a single unit. The printing apparatus 1 of the present embodiment is, for example, a printing apparatus of a serial head type as illustrated in FIG. 2. The serial head type is a type that performs printing in a paper width by causing the printing head 30 to reciprocate in the paper width direction. The paper width direction may be referred to as the main scanning direction. The paper width direction or the main scanning direction corresponds to D2 in FIG. 2.

The printing head 30 includes a plurality of head units 31. Each head unit 31 includes, for example, a plurality of nozzles arranged in the transport direction and a head control portion. Ink accommodated in an ink tank is supplied to the printing head 30 by the ink supply unit 80 described later.

The drive signal generation portion 40 generates a drive signal. When the drive signal is applied to a piezo element that is a drive element, the piezo element expands and contracts, and ink is ejected from each nozzle. The head control portion performs a control for ejecting ink to the printing medium from the nozzle based on a head control signal from the processor 102 and the drive signal from the drive signal generation portion 40. Accordingly, an image is formed on the printing medium.

The ink suction unit 50 sucks and discharges ink in the head to the outside of the head from the nozzle of the printing head 30. The ink suction unit 50 sucks ink in the printing head 30 together with air bubbles mixed in the printing head 30 by operating a suction pump, not illustrated, to form a negative pressure in a space of a cap in a state where the cap, not illustrated, is brought into close contact with a nozzle surface of the printing head 30. Accordingly, it is possible to recover from an ejection failure of the nozzle.

The wiping unit 55 removes a liquid droplet clinging to a nozzle plate of the printing head 30. The wiping unit 55 includes a wiper that can abut on the nozzle plate of the printing head 30. The wiper is an elastic member having flexibility. When the carriage 21 is moved in the paper width direction by driving the carriage motor, a tip end portion of the wiper is bent by abutting on the nozzle plate of the printing head 30. Accordingly, the wiping unit 55 removes a liquid droplet clinging to the nozzle plate. Alternatively, the wiping unit 55 may include a wiping member such as cloth and a first winding shaft and a second winding shaft around which the wiping member is wound. The wiping member wound around the first winding shaft is fed to the second winding shaft by a given feeding unit. The liquid droplet clinging to the nozzle plate is removed by pressing the wiping member to the nozzle plate on a path of feeding. Wiping of the wiping unit 55 can suppress occurrence of curved flight caused by condensation. The wiping unit 55 may be used for removing a foreign object such as paper dust clinging to the nozzle plate. In this case, ink can be normally ejected from the nozzle that is clogged with the foreign object.

The flushing unit 60 receives and retains ink ejected by a flushing operation performed by the printing head 30. The flushing operation is an operation of applying a drive signal not related to the image to be printed to the drive element and forcibly ejecting ink droplets continuously from the nozzle. Accordingly, a situation in which an appropriate amount of ink is not ejected due to thickening and drying of ink in the head can be suppressed. Thus, it is possible to recover from the ejection failure of the nozzle.

The capturing unit 70 examines the ejection failure based on the state of the printed image formed on the paper sheet S. The capturing unit 70 includes a capturing portion 71 and an image processing portion 72. For example, the capturing unit 70 acquires ejection result image information by capturing a result of ejecting ink to the printing medium. The image processing portion 72 and the controller 100 are individually illustrated in FIG. 1. However, the image processing portion 72 may be implemented by the controller 100. The capturing unit 70 is mounted in, for example, the carriage 21 as illustrated in FIG. 2. By doing so, even when an angle of view of the capturing portion 71 is narrower than the paper width, a wide range of a printing result can be efficiently captured.

The ink supply unit 80 supplies ink accommodated in an ink tank IT to the printing head 30. The printing apparatus 1 in the present embodiment is assumed to be a printing apparatus of an off-carriage type in which the ink tank IT is not mounted in the carriage 21. In this case, the length of an ink supply path is increased compared to a printing apparatus of an on-carriage type. Thus, it is difficult to supply ink using suction by the ink suction unit 50 from a nozzle side, or a water head pressure. Thus, the ink supply unit 80 of the present embodiment includes a pressurization pump 81 for supplying ink up to the closest point to the printing head 30 in a pressurized state. Details of the ink supply unit 80 will be described later.

The controller 100 is a control unit for controlling the printing apparatus 1. The controller 100 includes an interface portion 101, the processor 102, a memory 103, and a unit control circuit 104. The interface portion 101 transmits and receives data between the printing apparatus 1 and the computer CP that is an external apparatus. The processor 102 is a calculation processing device for controlling the entire printing apparatus 1. For example, the processor 102 is a central processing unit (CPU). The memory 103 is used for securing a region for storing a program of the processor 102, a work region, and the like. The processor 102 controls each unit in accordance with the program stored in the memory 103 using the unit control circuit 104.

The detector group 90 monitors an operation situation of the printing apparatus 1 and includes, for example, a temperature sensor 91, a humidity sensor 92, and an air pressure sensor 93. The detector group 90 may include sensors, not illustrated, such as an air bubble sensor, a dust sensor, and a crease sensor. In addition, the detector group 90 may include configurations such as a rotary encoder used for controlling transport and the like of the printing medium, a paper sheet detection sensor detecting whether or not the transported printing medium is present, and a linear encoder for detecting a position in a movement direction of the carriage 21.

The printing apparatus 1 of the serial head type is described above. Alternatively, the printing apparatus 1 of the present embodiment may be a printing apparatus of a line head type in which the printing head 30 is disposed to cover the width of the paper sheet.

1.2 Configuration Example of Ink Supply Unit

As disclosed in JP-A-2016-215478 or the like, in a region in which the air pressure is low, ink may not be supplied to the printing head 30, and an ejection failure may occur. The region in which the air pressure is low is, for example, a highland in South America. That is, it is known that the air pressure affects ink supply to the printing head 30 from the ink tank IT.

JP-A-2016-215478 discloses a method of controlling a negative pressure in a head. Controlling the negative pressure in the head corresponds to a control using the ink suction unit 50 in the printing apparatus 1 of the present embodiment. In the printing apparatus of the on-carriage type in which both of an ink cartridge and the printing head are mounted in the carriage, the length of the ink supply path is short. Thus, ink is easily supplied by the ink suction unit 50.

However, in the present embodiment, the printing apparatus 1 of a large size used for production in a factory or the like is assumed. The printing apparatus 1 that is a production apparatus uses the ink tank IT having a large capacity and thus, is assumed to be an apparatus of the off-carriage type. In this case, the length of the ink supply path from the ink tank IT to the printing head 30 is increased compared to the on-carriage type. Thus, it is difficult to supply ink using the ink suction unit 50. The water head pressure can be used for ink supply by setting the position of the ink tank IT in a vertical direction to be higher than the printing head 30. However, when the ink tank IT having a large capacity is arranged at a high position, it is difficult to refill the ink tank IT with ink. In addition, since the magnitude of the water head pressure is limited, it is difficult to smoothly supply ink.

Considering the above point, the printing apparatus 1 of the present embodiment includes the ink supply unit 80 different from the ink suction unit 50. The ink supply unit 80 includes the pressurization pump 81 for supplying ink up to the closest point to the printing head 30 in the pressurized state. By doing so, ink can be appropriately supplied to the printing head 30 in the printing apparatus 1 of the off-carriage type. Hereinafter, a specific example of the ink supply unit 80 will be described.

Figure 3:
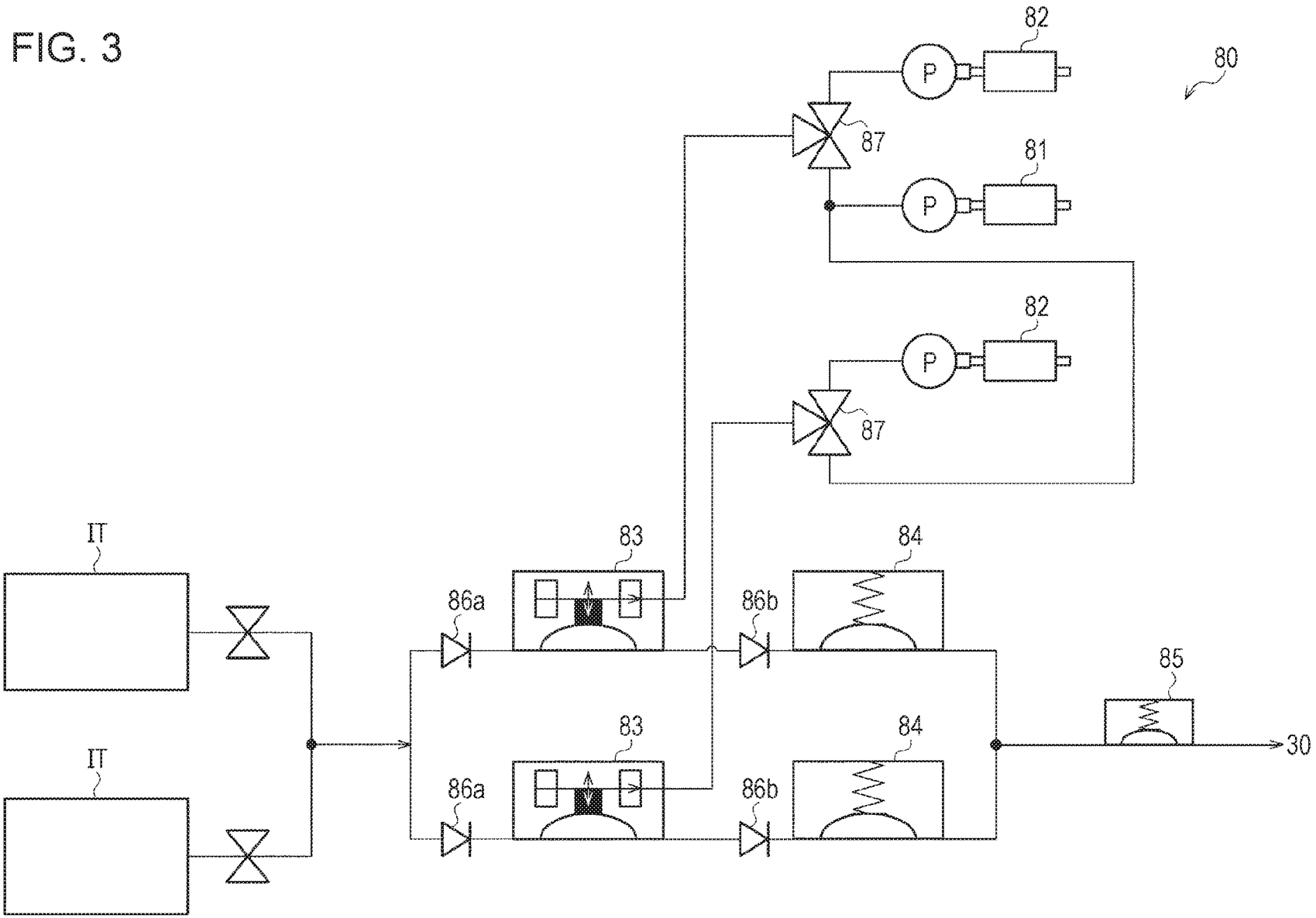
FIG. 3 is a configuration example of an ink supply unit.

FIG. 3 is a diagram illustrating a configuration of the ink supply unit 80. The ink supply unit 80 includes the pressurization pump 81, a depressurization pump 82, and a flow passage pump 83. The flow passage pump 83 is disposed in a flow passage from the ink tank IT to the printing head 30. Pressurization is performed by the pressurization pump 81, and depressurization is performed by the depressurization pump 82.

Figure 4:
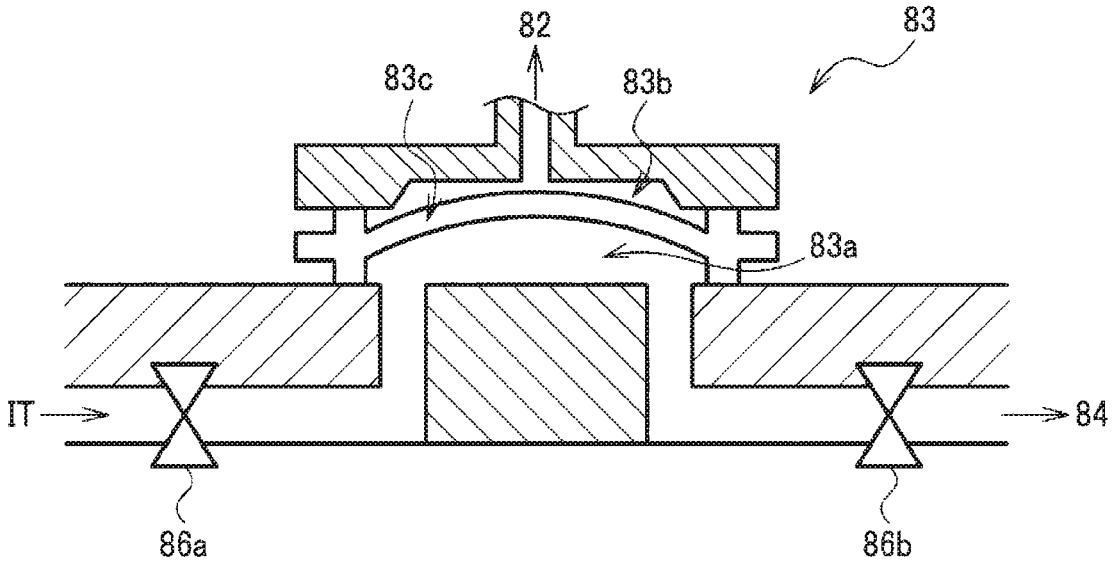
FIG. 4 is a diagram for describing suction driving.
Figure 5:
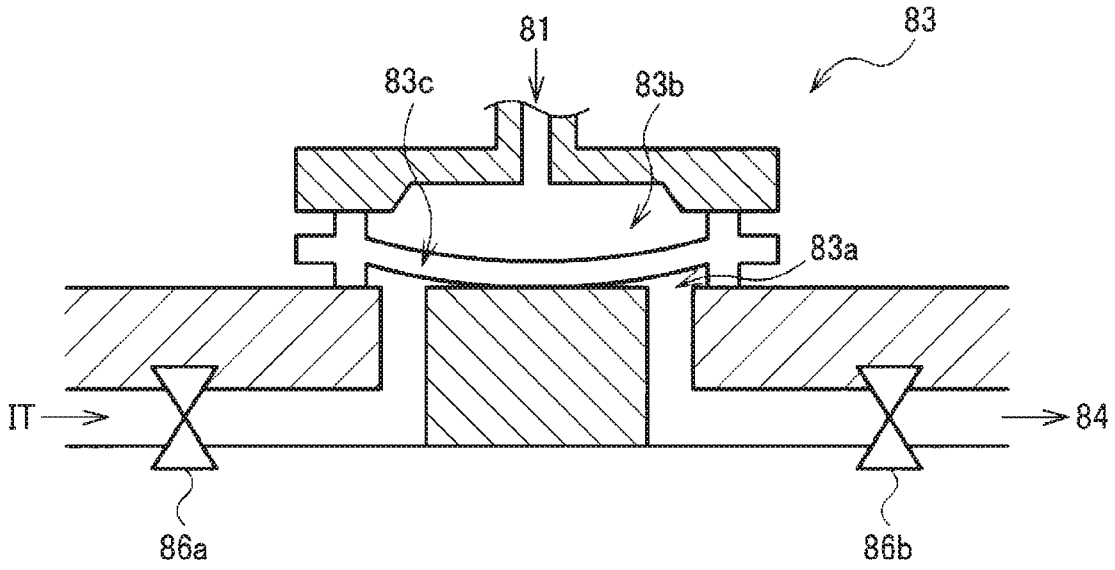
FIG. 5 is a diagram for describing ejection driving.

FIG. 4 is a diagram for describing suction driving of the flow passage pump 83, and FIG. 5 is a diagram for describing ejection driving of the flow passage pump 83. When the ink supply unit 80 supplies ink to a printing head 30 side from an ink tank IT side, first, a sealing valve 87 is controlled such that a communicating state is set between the depressurization pump 82 and the flow passage pump 83 and a sealed state is set between the pressurization pump 81 and the flow passage pump 83. The processor 102 drives a pump motor of the depressurization pump 82 in order to perform pump driving of the flow passage pump 83. Accordingly, a negative pressure is generated, and a second space 83*b* is set to a negative pressure state by the negative pressure. Thus, a diaphragm 83*c* of the flow passage pump 83 is elastically deformed to a second space 83*b* side and reduces the capacity of the second space 83*b*. Conversely, the capacity of a first space 83*a* divided from the second space 83*b* through the diaphragm 83*c* is increased in accordance with reduction in capacity of the second space 83*b*. At this point, a suction unidirectional valve 86*a* is in a valve-open state, and an ejection unidirectional valve 86*b* is in a valve-closed state. An ink flow passage from the ink tank IT to the flow passage pump 83 is set to the communicating state, and ink from the ink tank IT is sucked into the first space 83*a*.

The flow passage pump 83 may include a sensor detecting the negative pressure becoming greater than or equal to a predetermined pressure. The processor 102 drives the pump motor of the depressurization pump 82 until the negative pressure becoming greater than or equal to the predetermined pressure is detected by the sensor. For example, the flow passage pump 83 includes a conductive portion that is moved in accordance with elastic deformation of the diaphragm 83*c*. The conductive portion is arranged to come into contact with a second conductive portion and a third conductive portion when the diaphragm 83*c* elastically deformed to the second space 83*b* side by greater than or equal to a predetermined amount. That is, an energized state is set between the second conductive portion and the third conductive portion when the diaphragm 83*c* is elastically deformed to the second space 83*b* side by greater than or equal to the predetermined amount, and an insulating state is set therebetween in other cases. By doing so, whether or not the diaphragm 83*c* is elastically deformed to the second space 83*b* side by greater than or equal to the predetermined amount, that is, whether or not the negative pressure is greater than or equal to the predetermined pressure, can be detected by detecting a resistance value or a current value between the second conductive portion and the third conductive portion. For example, when ink is not sucked regardless of the negative pressure being greater than or equal to the predetermined pressure, a determination that ink in the ink tank IT is low can be made.

Next, the sealing valve 87 is controlled such that the communicating state is set between the pressurization pump 81 and the flow passage pump 83 and the sealed state is set between the depressurization pump 82 and the flow passage pump 83. The processor 102 drives a pump motor of the pressurization pump 81. Accordingly, pressurization is generated, and the second space 83*b* is set to the pressurized state by the pressurization. Consequently, as illustrated in FIG. 5, the diaphragm 83*c* is elastically deformed to an inner bottom surface side of the first space 83*a* and increases the capacity of the second space 83*b*. Conversely, the capacity of the first space 83*a* of the flow passage pump 83 divided from the second space 83*b* through the diaphragm 83*c* is reduced in accordance with the increase in capacity of the second space 83*b*. At this point, the suction unidirectional valve 86*a* is in the valve-closed state, and the ejection unidirectional valve 86*b* is in the valve-open state. The diaphragm 83*c* is displaced in a downward direction and pressurizes ink sucked inside the first space 83*a* at a predetermined pressure. Thus, ink is ejected from the inside of the first space 83*a*. By disposing the suction unidirectional valve 86*a*, backflow of ink ejected from the first space 83*a* in accordance with the ejection driving to the ink tank IT side is regulated.

Ink in the ink tank IT is supplied to the printing head 30 by alternately repeating the suction driving and the ejection driving. The suction driving and the ejection driving are exclusively performed. Thus, ink is not ejected from the flow passage pump 83 during the suction driving. Thus, as illustrated in FIG. 3, the ink supply unit 80 includes a flow passage buffer 84 disposed downstream of the ejection unidirectional valve 86*b*. Ink retained in the flow passage buffer 84 can be supplied even when ink is consumed in the printing head 30 during the suction driving. The ink supply unit 80 may further include an auxiliary flow passage buffer 85.

The above configuration may be multiplexed in order to further stabilize ink supply. In the example illustrated in FIG. 3, the number of each of the ink tank IT, the flow passage pump 83, the flow passage buffer 84, the suction unidirectional valve 86*a*, and the ejection unidirectional valve 86*b* disposed is two. While one flow passage pump 83 performs the suction driving, the other flow passage pump 83 performs the ejection driving. By doing so, even when any one flow passage pump 83 is performing the suction driving, ink can be supplied from the other flow passage pump 83. Thus, ink supply from the ink tank IT to the printing head 30 can be stabilized. In FIG. 3, an example in which two depressurization pumps 82 are disposed and one pressurization pump 81 is shared between two flow passage pumps 83 is illustrated. Alternatively, a plurality of pressurization pumps 81 may be disposed.

Figure 6:
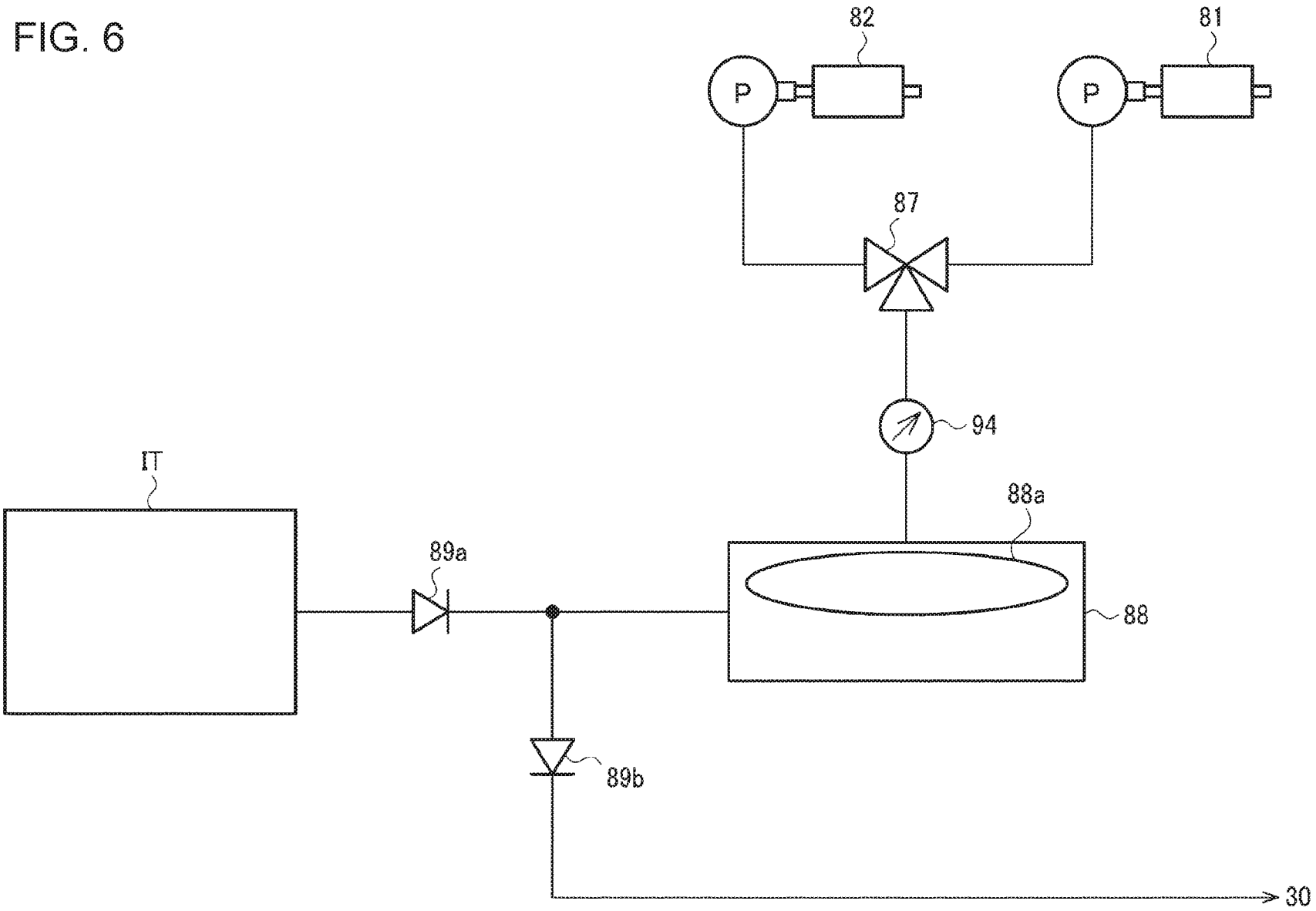
FIG. 6 is a configuration example of the ink supply unit.

FIG. 6 is a diagram illustrating another configuration of the ink supply unit 80. The ink supply unit 80 may include an intermediate tank 88 in which ink sucked by the depressurization pump 82 is accumulated. The pressurization pump 81 supplies ink to the printing head 30 by pressurizing the intermediate tank 88.

Specifically, first, the sealing valve 87 is controlled such that the communicating state is set between the depressurization pump 82 and the intermediate tank 88 and the sealed state is set between the pressurization pump 81 and the intermediate tank 88. The processor 102 drives the pump motor of the depressurization pump 82. Accordingly, a negative pressure is generated, and the intermediate tank 88 is set to the negative pressure state by the negative pressure. Accordingly, ink from the ink tank IT is sucked into the intermediate tank 88. At this point, a suction unidirectional valve 89*a* is in the valve-open state, and an ejection unidirectional valve 89*b* is in the valve-closed state.

Next, the sealing valve 87 is controlled such that the communicating state is set between the pressurization pump 81 and the intermediate tank 88 and the sealed state is set between the depressurization pump 82 and the intermediate tank 88. The processor 102 drives the pump motor of the pressurization pump 81. Accordingly, pressurization is generated, and the intermediate tank 88 is set to the pressurized state by the pressurization. More specifically, the pressurization pump 81 pressurizes a balloon 88*a* disposed inside the intermediate tank 88. By increasing the volume of the balloon 88*a,* the balloon 88*a* pressurizes ink at a predetermined pressure. Thus, ink is ejected from the intermediate tank 88. At this point, the suction unidirectional valve 89*a* is in the valve-closed state, and the ejection unidirectional valve 89*b* is in the valve-open state.

The ink supply unit 80 may include a pressure detection sensor 94 as illustrated in FIG. 6. The pressure detection sensor 94 is, for example, a micro electro mechanical systems (MEMS) pressure sensor. Sensors having other configurations may also be used as the pressure detection sensor 94. In the suction driving, for example, the processor 102 rotates the pump motor of the depressurization pump 82 a predetermined number of times and then, acquires a detected value of the pressure detection sensor 94 and determines whether or not the detected value has reached a set value. When the set value has been reached, the processor 102 stops driving the pump motor. When the set value has not been reached, the pump motor is rotated a predetermined number of times again, and then, the detected value of the pressure detection sensor 94 is acquired. The same applies to the ejection driving. The processor 102 controls the pump motor of the pressurization pump 81 by comparing the value of the pressure detection sensor 94 with the set value.

The pressure detection sensor 94 may have an air flow passage and be capable of detecting a pressure corresponding to an atmospheric pressure by opening the air flow passage. In this case, the set value may be set using a pressure value corresponding to the atmospheric pressure as a reference. For example, a pressurization control for increasing a pressure by a first set value from the pressure value corresponding to the atmospheric pressure and a depressurization control for decreasing a pressure by a second set value from the pressure value corresponding to the atmospheric pressure are performed.

As described above, even when the intermediate tank 88 is used, ink is supplied to the printing head 30 by performing the suction driving and the ejection driving. The amount of ink retainable in the intermediate tank 88 is greater than the amount of ink retainable in the flow passage pump 83 or the flow passage buffer 84. Thus, the ink supply unit 80 in FIG. 6 can reduce a frequency of switching between the suction driving and the ejection driving.

While a configuration of a part of the ink supply unit 80 may be multiplexed in the same manner as the example in FIG. 3, illustration is not provided in FIG. 6. For example, the ink supply unit 80 includes two ink tanks IT and two intermediate tanks 88. By doing so, ink supply from the ink tank IT to the printing head 30 can be stabilized.

1.3 Method of Present Embodiment

As described above, ink in the pressurized state can be supplied to the vicinity of the printing head 30 using the ink supply unit 80 including the pressurization pump 81. Here, the vicinity of the printing head 30 specifically represents the closest point to the sealing valve thereof disposed in the printing head 30. A method of the related art such as JP-A-2016-215478 does not assume a control of a pressurization force. That is, while the pressurization force provided by the pressurization pump 81 is affected by the atmospheric pressure, adjustment of the pressurization force is not disclosed in the method of the related art. Particularly, while a control of a depressurization force is limited to a control for implementing an air pressure of −1 maximum, that is, a state close to a vacuum, the pressurization force can be controlled within a wide range such as an air pressure of +10 or an air pressure of +20 compared to depressurization. While an ejection failure occurs when the pressurization force is insufficient, an excessive pressurization force is also not desirable. Thus, it is difficult to control the pressurization force compared to the depressurization force.

Thus, in the present embodiment, the pressurization force of the pressurization pump 81 is controlled based on air pressure information in a usage environment of the printing apparatus 1. The usage environment refers to an environment in which the printing apparatus 1 is used. The printing apparatus 1 is assumed to be used inside a room. Thus, in a narrow sense, an air pressure in the usage environment is an air pressure measured inside the room. When a determination that a difference in air pressure between the inside and the outside of the room is small is made, the air pressure outside the room such as the atmospheric pressure calculated based on an altitude as described later may be used as the air pressure information in the usage environment. By doing so, even when the air pressure of the usage environment is changed, a pressurization force control that can suppress an ejection failure can be performed.

As illustrated in FIG. 6, the ink supply unit 80 may include the pressure detection sensor 94 that can measure the pressurization force. In this case, by monitoring an output of the pressure detection sensor 94, the processor 102 can determine whether or not a desired pressurization force is obtained. Particularly, when the pressure detection sensor 94 that can measure the pressurization force using the atmospheric pressure as a reference is used, an effect caused by a change in atmospheric pressure is also considered. Thus, it is considered that the pressurization force control is easily performed.

It is known that the viscosity of ink that is fluid assumed in the present embodiment is changed due to an ambient environment such as temperature. The desired pressurization force is changed in accordance with a degree of thickening of ink. Thus, even when the pressure detection sensor 94 is used, it is difficult to implement an appropriate pressurization force control from only the air pressure information. In addition, in a broad sense, it is considered that physical properties or operation characteristics of a member related to ink supply depend on temperature. Even in this case, a content of control necessary for appropriately supplying ink to the printing head 30 from the ink tank IT is changed depending on temperature. That is, an appropriate content of control for the pressurization pump 81 is changed depending on temperature characteristics of ink or the ink supply unit 80. Thus, it is difficult to implement an appropriate pressurization force control from only the air pressure information.

Considering the above point, the pressurization force of the pressurization pump 81 is controlled based on temperature information in the usage environment in addition to the air pressure information in the present embodiment. A temperature in the usage environment may be the temperature of the inside of the room in which the printing apparatus 1 is installed, or may be an internal temperature of the printing apparatus 1. By doing so, it is possible to implement a desired pressurization force control considering even the temperature characteristics related to ink supply such as thickening of ink. Furthermore, a more highly accurate pressurization force control is implemented by applying machine learning in the present embodiment. Hereinafter, learning processing and inference processing using a learning result will be described.

2. Learning Processing 2.1 Configuration Example of Learning Device

Figure 7:
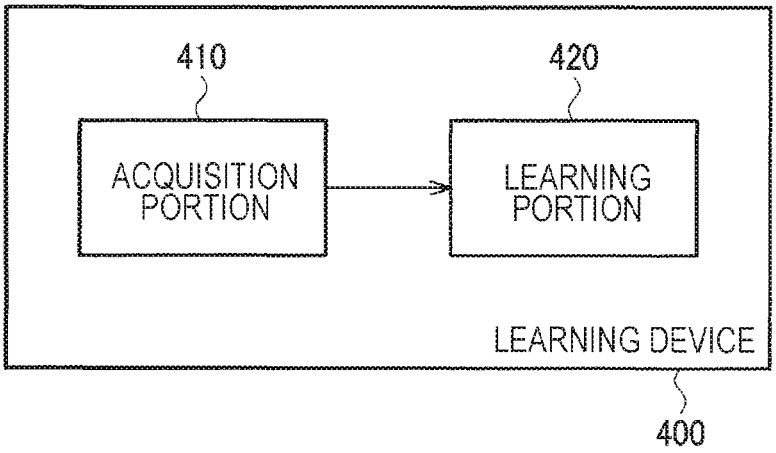
FIG. 7 is a configuration example of a learning device.

FIG. 7 is a diagram illustrating a configuration example of a learning device 400 of the present embodiment. The learning device 400 includes an acquisition portion 410 acquiring training data used for learning and a learning portion 420 performing machine learning based on the training data.

The acquisition portion 410 is, for example, a communication interface for acquiring the training data from another device. Alternatively, the acquisition portion 410 may acquire the training data stored in the learning device 400. For example, the learning device 400 includes a storage portion, not illustrated, and the acquisition portion 410 is an interface for reading the training data from the storage portion. Learning in the present embodiment is, for example, supervised learning. The training data in supervised learning is a data set in which input data is associated with an answer label.

The learning portion 420 generates a learned model by performing machine learning based on the training data acquired by the acquisition portion 410. The learning portion 420 of the present embodiment is configured with the following hardware. The hardware can include at least one of a circuit processing a digital signal and a circuit processing an analog signal. For example, the hardware can be configured with one or a plurality of circuit devices or one or a plurality of circuit elements packaged in a circuit substrate. One or the plurality of circuit devices are, for example, ICs. One or the plurality of circuit elements are, for example, resistors or capacitors.

The learning portion 420 may be implemented by the following processor. The learning device 400 of the present embodiment includes a memory storing information and the processor operating based on the information stored in the memory. The information includes, for example, a program and various data. The processor includes the hardware. Various processors such as a CPU, a graphics processing unit (GPU), and a digital signal processor (DSP) can be used as the processor. The memory may be a semiconductor memory such as a static random access memory (SRAM) or a dynamic random access memory (DRAM), a register, a magnetic storage device such as a hard disk device, or an optical storage device such as an optical disk device. For example, the memory stores a command readable by a computer. The function of each portion of the learning device 400 is implemented as processing by causing the processor to execute the command. The command here may be a command of a command set constituting the program or may be a command for instructing a hardware circuit of the processor to operate. For example, the memory stores the program prescribing a learning algorithm, and the processor executes learning processing by operating in accordance with the learning algorithm.

More specifically, the acquisition portion 410 acquires a data set in which the air pressure information, the temperature information, and pressurization force information are associated. The air pressure information is information indicating the air pressure in the usage environment of the printing apparatus 1. The temperature information is information indicating the temperature in the usage environment of the printing apparatus 1. The pressurization force information is information indicating the pressurization force of the pressurization pump 81 for supplying ink to the printing head 30.

According to a method of the present embodiment, machine learning is performed using not only the air pressure information but also the temperature information. An appropriate pressurization force control considering even thickening of ink can be performed using a result of machine learning. For example, when an ejection failure easily occurs due to thickening of ink, it is possible to perform a control for increasing the pressurization force. When the viscosity of ink is decreased, a problem caused by an excessive pressure is suppressed by performing a control for decreasing the pressurization force.

The learning device 400 illustrated in FIG. 7 may be included in, for example, the printing apparatus 1 illustrated in FIG. 1. In this case, the learning portion 420 corresponds to the controller 100 of the printing apparatus 1. More specifically, the learning portion 420 may be the processor 102. The printing apparatus 1 accumulates the air pressure information and the temperature information in the memory 103. The acquisition portion 410 may be an interface for reading the air pressure information and the temperature information accumulated in the memory 103. The printing apparatus 1 may transmit the accumulated air pressure information and the temperature information to an external apparatus such as the computer CP or a server system. The acquisition portion 410 may be the interface portion 101 for receiving the training data necessary for learning from the external apparatus. The pressurization force information may be, for example, control information about the pressurization pump 81 or may be information indicating a pressure value estimated from the control information. In this case, the pressurization force information may be accumulated in the memory 103 or may be transmitted to the external apparatus in the same manner as the air pressure information and the temperature information. Alternatively, the pressurization force information may be information manually input by a user. The user here is a user such as a developer or an experienced service technician of the printing apparatus 1 having knowledge related to the pressurization force in ink supply.

The learning device 400 may be included in an apparatus different from the printing apparatus 1. For example, the learning device 400 may be included in an external apparatus connected to the printing apparatus 1 through a network. The network here may be a private network such as an intranet or may be a public communication network such as the Internet. The network may be either wired or wireless.

2.2 Neural Network

Figure 8:
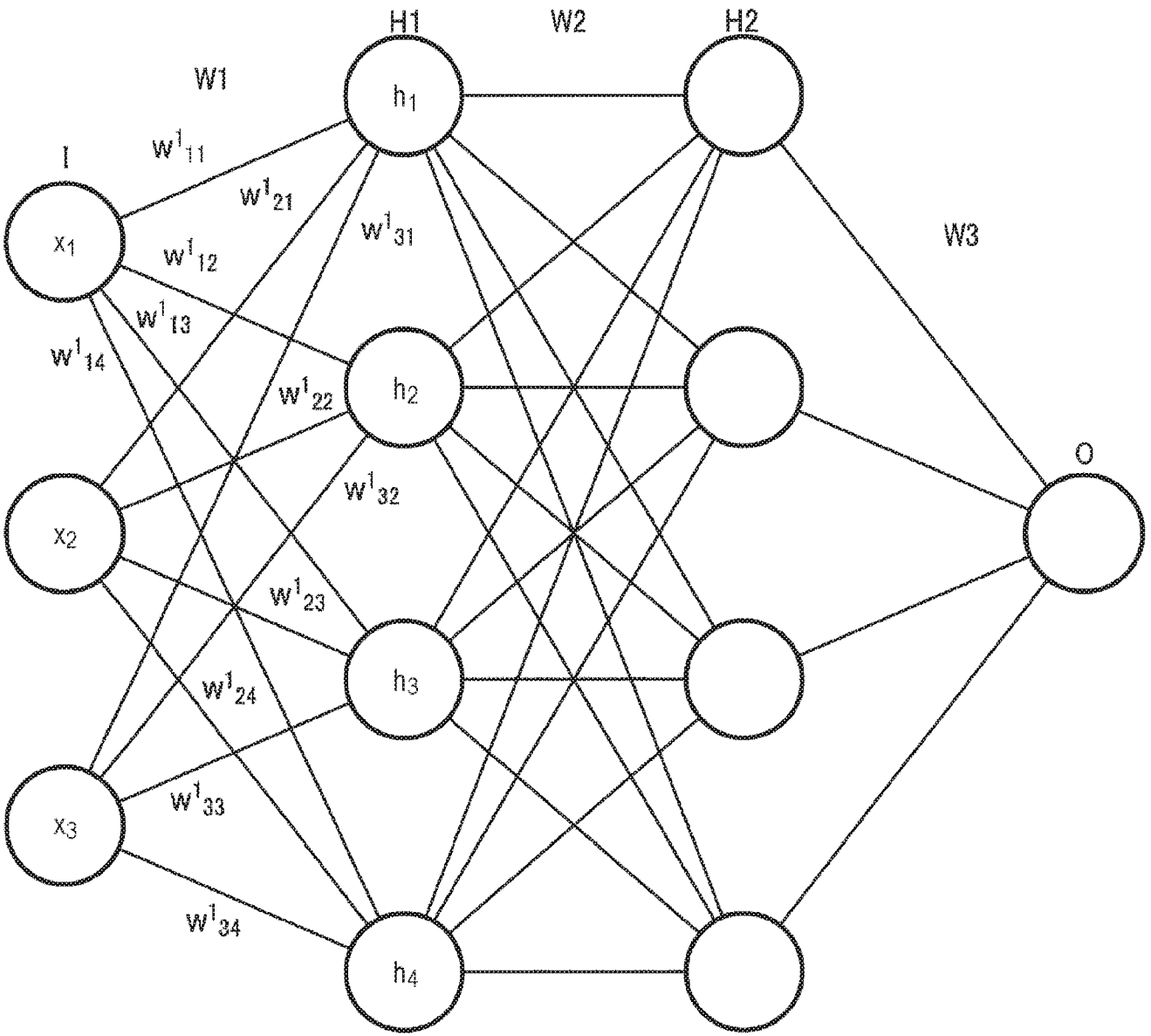
FIG. 8 is a descriptive diagram of a neural network.

Machine learning using a neural network will be described as a specific example of machine learning. FIG. 8 is a basic structure example of the neural network. The neural network is a mathematical model for simulating a brain function in a computer. One circle in FIG. 8 is called a node or a neuron. In the example in FIG. 8, the neural network includes an input layer, two intermediate layers, and an output layer. The input layer is denoted by I. The intermediate layers are denoted by H1 and H2. The output layer is denoted by O. In addition, in the example in FIG. 8, the number of neurons of the input layer is three. The number of neurons of each intermediate layer is four. The number of neurons of the output layer is one. Various modifications can be made to the number of layers of the intermediate layers and the number of neurons included in each layer. The neurons included in the input layer are connected to the neurons of H1 that is a first intermediate layer. The neurons included in the first intermediate layer are connected to the neurons of H2 that is a second intermediate layer. The neurons included in the second intermediate layer are connected to the neuron of the output layer. The intermediate layer may be referred to as a hidden layer.

The input layer includes each neuron outputting an input value. In the example in FIG. 8, the neural network receives $x_1$, $x_2$, and $x_3$ as input, and the neurons of the input layer output $x_1$, $x_2$, and $x_3$, respectively. Any preprocessing may be performed on the input value, and each neuron of the input layer may output the value after preprocessing.

In each neuron from the intermediate layers, calculation simulating a state where information is transmitted as an electric signal in a brain is performed. In the brain, the transmissibility of information is changed depending on connection strength between synapses. Thus, the connection strength is represented by a weight W in the neural network. W1 in FIG. 8 is a weight between the input layer and the first intermediate layer. W1 denotes a set of weights between a given neuron included in the input layer and a given neuron included in the first intermediate layer. When a weight between a p-th neuron of the input layer and a q-th neuron of the first intermediate layer is denoted by $w^1_{pq}$, W1 in FIG. 8 is information including 12 weights of $w^1_{11}$ to $w^1_{34}$. In a broader sense, the weight W1 is information including weights in number corresponding to the product of the number of neurons of the input layer and the number of neurons of the first intermediate layer.

In the first intermediate layer, calculation illustrated in Expression (1) below is performed in the first neuron. In one neuron, calculation of finding the sum of products of outputs of neurons of an immediately previous layer connected to the neuron and further adding a bias is performed. The bias in Expression (1) below is denoted by $b_1$.

$$h_1 = f\left(\sum w^1_{i1} \cdot x_i + b_1\right) \tag{1}$$

As illustrated in Expression (1) above, an activation function f that is a non-linear function is used in calculation in one neuron. For example, a ReLU function illustrated in Expression (2) below is used as the activation function f. The ReLU function is a function that outputs zero when a variable is less than or equal to zero, and outputs the value of the variable itself when the variable is greater than zero. It is known that various functions can be used as the activation function f. A sigmoid function may be used, or a function obtained by improving the ReLU function may be used. While a calculation expression with respect to $h_1$ is illustrated in Expression (1) above, the same calculation may be performed in the other neurons of the first intermediate layer.

$$f(x) = \max(0,\ x) = \begin{cases} 0(x \le 0) \\ x(x \ge 0) \end{cases} \tag{2}$$

The same applies to the subsequent layers. For example, when a weight between the first intermediate layer and the second intermediate layer is denoted by W2, calculation of the sum of products using outputs of the first intermediate layer and the weight W2 and calculation of adding the bias and applying the activation function are performed in the neurons of the second intermediate layer. In the neuron of the output layer, calculation of weighting and adding outputs of the immediately previous layer and adding the bias is performed. In the example in FIG. 8, the immediately previous layer of the output layer is the second intermediate layer. In the neural network, a calculation result in the output layer is an output of the neural network.

As is perceived from the above description, it is necessary to set an appropriate weight and bias in order to obtain a desired output from an input. Hereinafter, the weight will also be referred to as the weighting coefficient. The bias may be included in the weighting coefficient. In learning, a data set in which a given input x is associated with a correct output for the input is prepared. The correct output is the answer label. The learning processing of the neural network can be considered as processing of obtaining the most probable weighting coefficient based on the data set. In the learning processing of the neural network, various learning methods such as backpropagation are known. These learning methods can be widely applied and thus, will not be described in detail in the present embodiment. The learning algorithm when the neural network is used is an algorithm of performing both of processing of acquiring a result in a forward direction by performing calculation such as Expression (1) above and processing of updating weighting coefficient information using backpropagation.

The neural network is not limited to the configuration illustrated in FIG. 8. For example, a widely-known convolutional neural network (CNN) may be used in the learning processing and inference processing, described later, of the present embodiment. The CNN includes a convolutional layer and a pooling layer. The convolutional layer performs convolution calculation. The convolution calculation here is specifically filter processing. The pooling layer performs processing of reducing the longitudinal and transverse sizes of data. In the CNN, characteristics of a filter used for the convolution calculation are learned by performing the learning processing using backpropagation or the like. That is, the characteristics of the filter in the CNN are included in the weighting coefficient in the neural network. The CNN is suitable when two-dimensional image data is used as ejection result image information.

An example in which the learned model is a model using the neural network is described above. However, machine learning in the present embodiment is not limited to a method using the neural network. For example, machine learning of various widely-known types such as a support vector machine (SVM) or machine learning of a type advanced from these types can be applied to the method of the present embodiment.

2.3 Example of Training Data and Details of Learning Processing

As described above, the air pressure information and the temperature information are considered as information related to a pressure control. The temperature information is, for example, numerical value data in units of ° C. Data in other forms may also be used as the temperature information. The temperature information is desirably information on which the temperature of ink from the ink tank IT to the printing head 30 is reflected. Thus, the temperature sensor 91 detecting the temperature information is disposed at, for example, a position at which a distance from the ink tank IT or the ink supply path is less than or equal to a predetermined threshold in the printing apparatus 1. However, the temperature sensor 91 is not limited to the position and may be disposed at another position in the printing apparatus 1. The temperature information may be information acquired by a temperature sensor arranged outside the printing apparatus in the same space as the printing apparatus 1.

The air pressure information is information indicating an air pressure of the printing apparatus 1 and is information represented using a unit such as pascal or $N/m^2$. Alternatively, considering that the air pressure and the altitude are correlated, the air pressure information may be calculated based on altitude information. The altitude information may be information indicating the altitude in information acquired from a global positioning system (GPS) or may be information acquired by combining the information from the GPS with map information. Alternatively, positional information about the printing apparatus 1 may be acquired by a unit other than the GPS, and the altitude information may be specified by combining the positional information with the map information. Accordingly, the air pressure information can be acquired using various methods.

The data set of the present embodiment includes the pressurization force information indicating a desired pressurization force in a situation specified using given air pressure information and temperature information. The pressurization force information may be information indicating the value of the desired pressurization force represented in units of pascal or $N/m^2$ or may be the control information about the pressurization pump 81 for implementing the desired pressurization force. For example, the control information about the pressurization pump 81 is information from which an operation time and an operation amount of the pump motor can be specified. The operation amount is, for example, a rotation amount of the pump motor.

For example, the printing apparatus 1 acquires and accumulates the air pressure information, the temperature information, and the control information about the pressurization pump 81 during operation. For example, it is considered that an ejection failure does not occur before a given timing and an ejection failure is detected at the given timing. The ejection failure may be detected by the processor 102 based on, for example, the ejection result image information. Alternatively, whether or not an ejection failure has occurred may be determined by causing the user to visually check the printing medium subjected to printing and input a check result into the printing apparatus 1 or the external apparatus. The ejection failure here is assumed to be a failure caused by an insufficient pressurization force. Thus, whether or not an ejection failure has occurred may be determined based on whether or not ink is supplied to the printing head 30 along the ink supply path. For example, in a learning stage, a sensor monitoring the ink supply path may be disposed, or the user may detach and visually check the printing head 30 when an ejection failure has occurred. While installation of a dedicated sensor or a work of the user is necessary, a purpose here is to generate the training data, and an increase in cost or downtime is not considered.

When an ejection failure is checked at a given timing, it is estimated that the pressurization force is insufficient in the printing apparatus 1 at the given timing. Thus, the training data is generated by associating the pressurization force information indicating a pressure value greater than the pressurization force at the timing with the air pressure information and the temperature information acquired at the timing. In a predetermined period before the given timing, an ejection failure does not occur, but a state where the pressurization force is insufficient and an ejection failure easily occurs is estimated. Thus, even in the predetermined period, the training data may be generated by associating the pressurization force information indicating a pressure value greater than the pressurization force in the predetermined period. In a period excluding the given timing and the predetermined period, it is estimated that the pressurization force is normal. Thus, the training data is generated by associating the pressurization force information indicating the pressurization force in the period with the air pressure information and the temperature information acquired in the period.

While an example in which the pressurization force is insufficient is described above, the same applies to a case in which the pressurization force is excessive. When a problem caused by an excessive pressurization force is checked at a given timing, the training data is generated by associating the pressurization force information for decreasing the pressurization force with the air pressure information and the temperature information acquired at the given timing or in a predetermined period before the given timing. For example, when a member such as the sealing valve on the ink supply path is repaired or replaced by maintenance provided by the service technician, a determination that a problem caused by an excessive pressurization force has occurred is made. The acquisition portion 410 may acquire maintenance information indicating a content of maintenance based on a user input provided by the service technician or the like. Alternatively, the maintenance information may be transmitted to the external apparatus such as the server system, and the acquisition portion 410 may acquire the maintenance information from the external apparatus.

Figure 9:
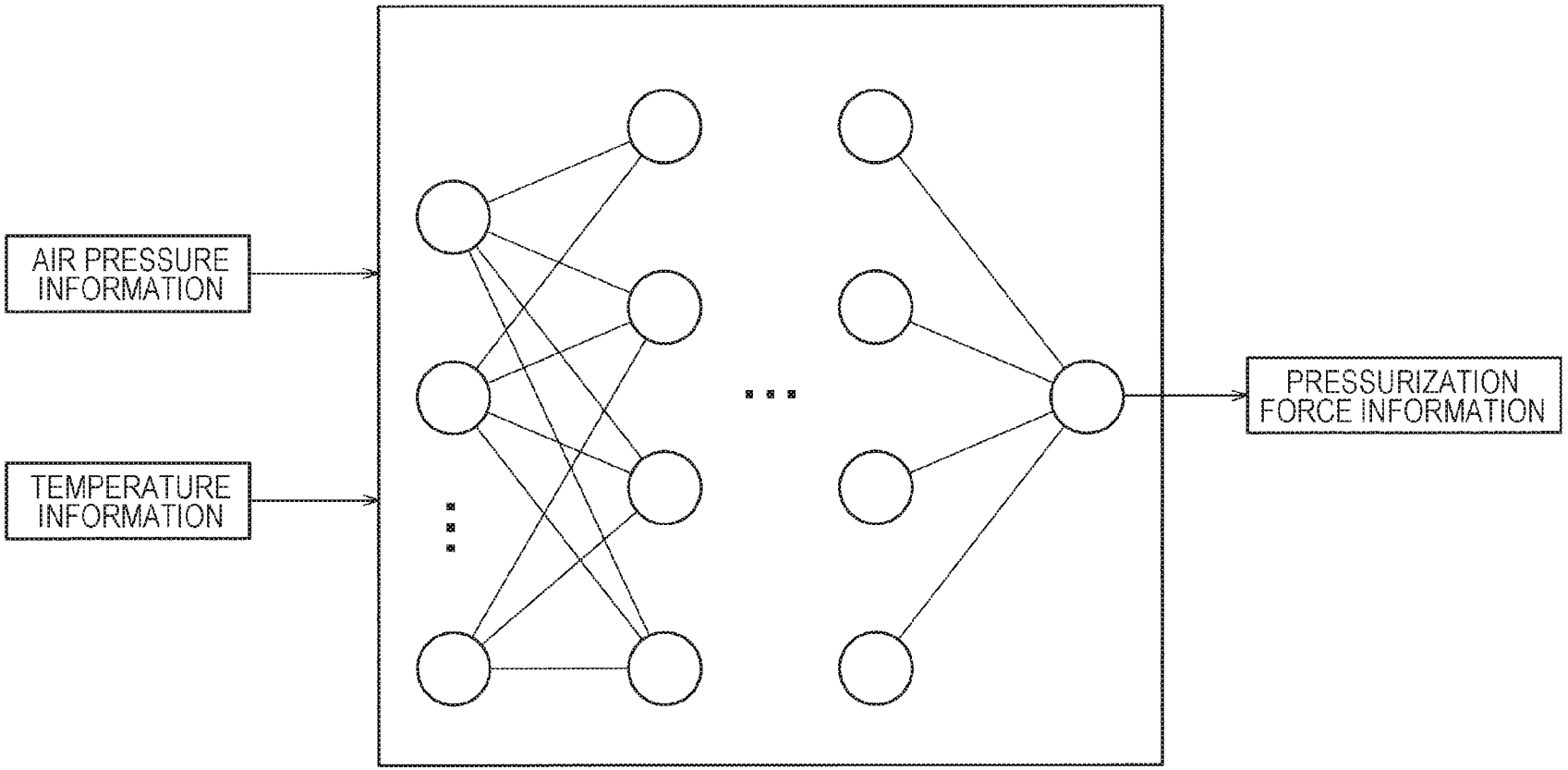
FIG. 9 is an example of an input and an output of the neural network.

FIG. 9 is one example illustrating the model of the neural network in the present embodiment. A neural network denoted by NN1 receives the air pressure information and the temperature information as input and outputs, as output data, the pressurization force information with which a determination that an ejection failure or the like does not occur is made.

For example, the learning processing based on the training data is performed in accordance with the following flow. First, the learning portion 420 inputs the input data into the neural network and acquires the output data by performing calculation in the forward direction using the weight at the time of input. In the present embodiment, the input data is the air pressure information and the temperature information. The output data obtained by calculation in the forward direction is information indicating a recommended pressurization force as described above.

The learning portion 420 calculates an error function based on the obtained output data and the answer label. The learning portion 420 updates the weighting coefficient information in a direction of decreasing error. Various forms of error functions are known and can be widely applied in the present embodiment. While the weighting coefficient information is updated using, for example, backpropagation, other methods may be used.

Above is a summary of the learning processing based on one training data. The learning portion 420 learns appropriate weighting coefficient information by repeating the same processing for other training data. For example, the learning portion 420 sets a part of acquired data as the training data and sets the rest as test data. The test data may be referred to as the evaluation data or the verification data. The learning portion 420 performs learning by applying the test data to the learned model generated using the training data until an answer ratio becomes greater than or equal to a predetermined threshold.

The information included in the data set is not limited to the air pressure information, the temperature information, and the pressurization force information. For example, the data set may include depressurization force information about the depressurization pump 82 sucking ink from the ink tank IT. The depressurization force information may be information indicating the value of a desired depressurization force represented in units of pascal or $N/m^2$ or may be control information about the depressurization pump 82 for implementing the desired depressurization force. For example, in the same manner as the pressurization force information described above, the depressurization force information may be information decided based on whether or not an ejection failure has occurred. Alternatively, the depressurization force information may be information decided by sensing or visually checking whether or not ink is appropriately supplied to the flow passage pump 83 or the intermediate tank 88 from the ink tank IT.

By doing so, a control considering thickening of ink due to temperature can be performed for not only the pressurization pump 81 but also the depressurization pump 82.

The data set may include type information about the pressurization pump 81 supplying ink to the printing head 30 or type information about the printing apparatus 1. For example, the type information about the pressurization pump 81 may be information for specifying a model number, information for specifying a maker, or both thereof and may include other information. The same applies to the type information about the printing apparatus 1. The type information about the printing apparatus 1 is information for specifying a maker or a model number.

A range of the atmospheric pressure recommended as the usage environment or a range of an implementable pressurization force varies depending on the pressurization pump 81. Thus, even a desired pressurization force may vary depending on the pressurization pump 81. More highly accurate pressurization force information can be estimated using the type information about the pressurization pump 81 in machine learning. The type of pressurization pump 81 can be specified based on the type of printing apparatus 1. Thus, highly accurate pressurization force information can also be estimated even when the type information about the printing apparatus 1 is used. When the type information about the printing apparatus 1 is used, processing considering a specific configuration of the ink supply unit 80 described above using FIG. 3 and FIG. 6, types of members other than the pressurization pump 81, and the like can be performed.

The data set may include the ejection result image information acquired by capturing the result of ejecting ink to the printing medium from the printing head 30. The ejection result image information may be the ejection result image which is the result of capturing, using the capturing portion 71, the printing medium on which an image is formed, or may be a result of image processing performed by the image processing portion 72. For example, the image processing portion 72 determines whether or not an ejection failure is present by determining whether or not a dot is formed at a position specified based on the printing data.

Machine learning considering whether or not an ejection failure has actually occurred can be performed using the ejection result image information. Thus, a learned model that can estimate appropriate pressurization force information can be generated.

The data set may include ink type information indicating the type of ink. For example, the ink type information is information for specifying a color material and is information indicating pigment ink or dye ink in a narrow sense. The ink type information may be more detailed raw material information from which a raw material can be specified, information indicating a maker or a model number, or information indicating color. The ink type information may be a combination of two or more of those information.

The viscosity of ink tends to be decreased as temperature is increased. However, a specific change in viscosity with respect to a change in temperature is considered to vary depending on characteristics of ink. More highly accurate pressurization force information can be estimated using the ink type information in machine learning.

Figure 10:
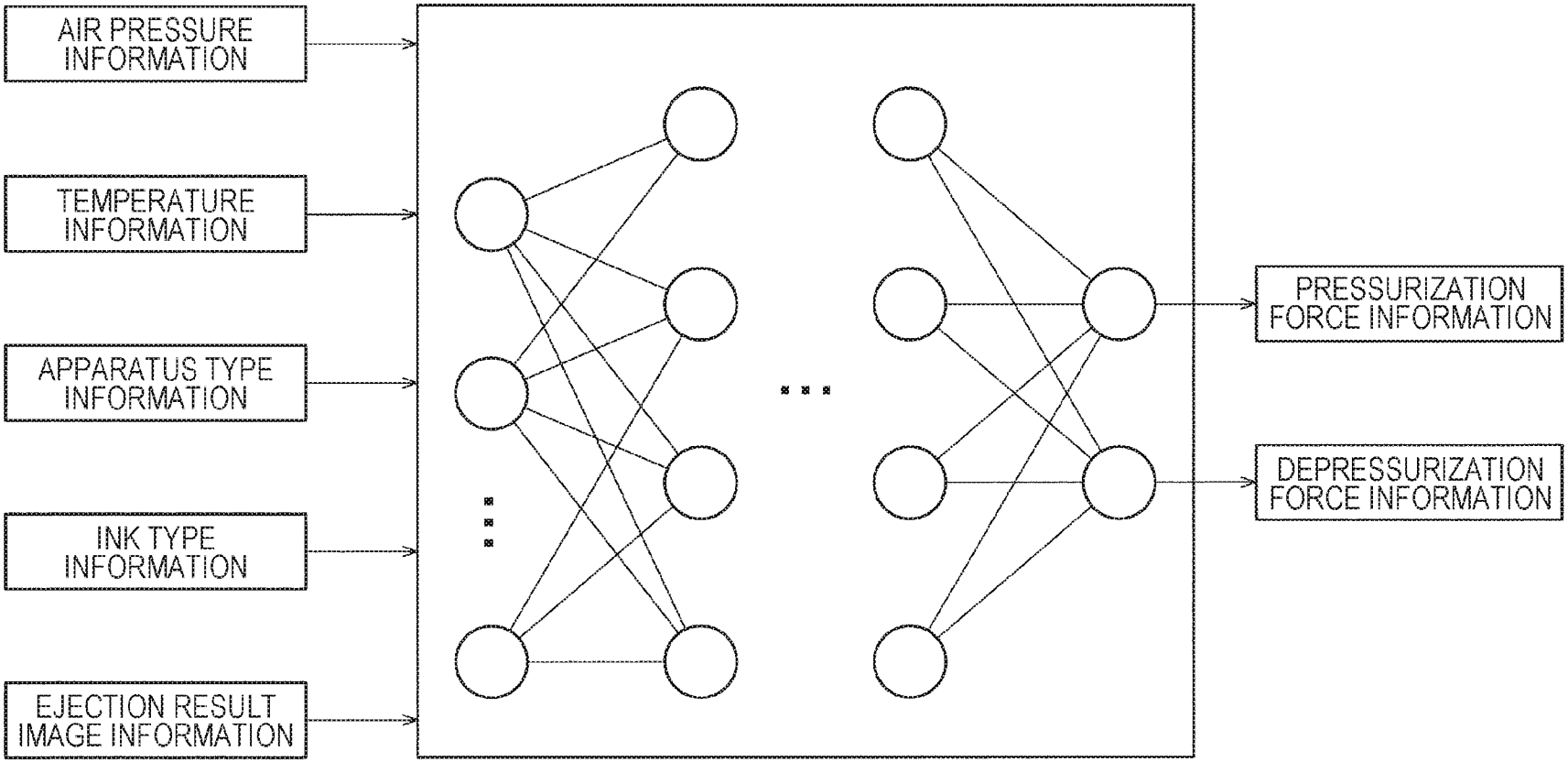
FIG. 10 is an example of the input and the output of the neural network.

FIG. 10 is one example illustrating the model of the neural network in the present embodiment. The neural network is a network that receives the air pressure information, the temperature information, apparatus type information, the ink type information, and the ejection result image information as input and outputs the pressurization force information and the depressurization force information. The apparatus type information may be information indicating the type of pressurization pump 81 or may be information indicating the type of printing apparatus 1 as described above. By doing so, a learned model capable of executing the inference processing considering a condition other than the air pressure and temperature can be generated. In addition, a learned model capable of estimating not only the pressurization force information but also the depressurization force information can be generated. A flow of learning processing is the same as the example in FIG. 9 and thus, will not be described in detail.

Figure 11:
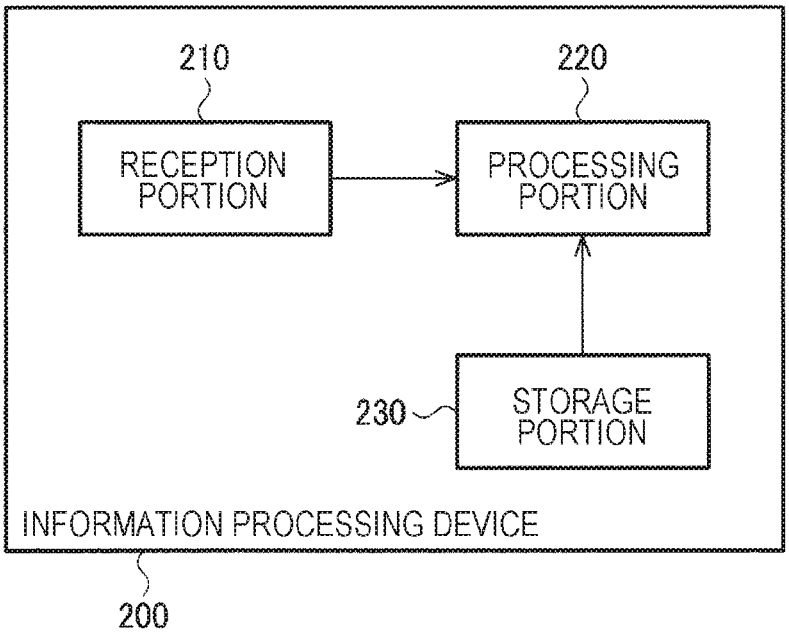
FIG. 11 is a configuration example of an information processing device.

3. Inference Processing 3.1 Configuration Example of Information Processing Device FIG. 11 is a diagram illustrating a configuration example of an inference device of the present embodiment. The inference device is the information processing device 200. The information processing device 200 includes the reception portion 210, the processing portion 220, and a storage portion 230.

The storage portion 230 stores the learned model trained by performing machine learning of a condition of the pressurization force with which a determination that an ejection failure does not occur is made, based on the data set in which the air pressure information, the temperature information, and the pressurization force information are associated. The "condition of the pressurization force with which a determination that an ejection failure does not occur is made" indicates a mutual relationship among an air pressure, a temperature, and a pressurization force with which a determination that an ejection failure does not occur can be made with a numerical value or a numerical value range of the pressurization force when the printing apparatus 1 is used at the air pressure and the temperature. The reception portion 210 receives the air pressure information and the temperature information at the time of ejecting ink as input. The processing portion 220 controls the pressurization pump 81 based on the air pressure information and the temperature information received as input and the learned model.

As described above, machine learning of a condition of the pressurization force considering even thickening of ink is performed using the air pressure information and the temperature information. Information indicating a desired pressurization force is output by inputting the air pressure information and the temperature information at the time of ejecting ink into the learned model generated by machine learning. Thus, a control of the pressurization pump 81 capable of suppressing an ejection failure can be performed.

The learned model is used as a program module that is a part of artificial intelligence software. The processing portion 220 outputs data representing the pressurization force information corresponding to the air pressure information and the temperature information as input in accordance with an instruction from the learned model stored in the storage portion 230.

In the same manner as the learning portion 420 of the learning device 400, the processing portion 220 of the information processing device 200 is configured with hardware including at least one of a circuit processing a digital signal and a circuit processing an analog signal. The processing portion 220 may be implemented by the following processor. The information processing device 200 of the present embodiment includes a memory storing information and the processor operating based on the information stored in the memory. Various processors such as a CPU, a GPU, and a DSP can be used as the processor. The memory may be a semiconductor memory, a register, a magnetic storage device, or an optical storage device. The memory here is, for example, the storage portion 230. That is, the storage portion 230 is an information storage medium such as a semiconductor memory, and a program such as the learned model is stored in the information storage medium.

Calculation in the processing portion 220 in accordance with the learned model, that is, calculation for outputting the output data based on the input data, may be executed by software or may be executed by hardware. In other words, calculation of the sum of products such as Expression (1) above may be executed by software. Alternatively, the calculation may be executed by a circuit device such as a field-programmable gate array (FPGA). The calculation may be executed by a combination of software and hardware. Accordingly, the operation of the processing portion 220 in accordance with the instruction from the learned model stored in the storage portion 230 can be implemented in various aspects. For example, the learned model includes an inference algorithm and a parameter used in the inference algorithm. The inference algorithm is an algorithm of performing calculation of the sum of products such as Expression (1) above based on the input data. The parameter is a parameter acquired by the learning processing and is, for example, the weighting coefficient information. In this case, both of the inference algorithm and the parameter may be stored in the storage portion 230, and the processing portion 220 may perform the inference processing by software by reading the inference algorithm and the parameter. Alternatively, the inference algorithm may be implemented by an FPGA or the like, and the storage portion 230 may store the parameter.

The information processing device 200 illustrated in FIG. 11 is included in, for example, the printing apparatus 1 illustrated in FIG. 1. That is, the method of the present embodiment can be applied to the printing apparatus 1 including the information processing device 200. In this case, the processing portion 220 corresponds to the controller 100 of the printing apparatus 1 and corresponds to the processor 102 in a narrow sense. The storage portion 230 corresponds to the memory 103 of the printing apparatus 1. The reception portion 210 corresponds to the interface for reading the air pressure information and the temperature information accumulated in the memory 103. The printing apparatus 1 may transmit the accumulated operation information to an external apparatus such as the computer CP or the server system. The reception portion 210 may be the interface portion 101 receiving the air pressure information and the temperature information necessary for inference from the external apparatus. Alternatively, the information processing device 200 may be included in an apparatus different from the printing apparatus 1. For example, the information processing device 200 is included in an external apparatus such as the server system collecting the operation information from a plurality of printing apparatuses 1. The external apparatus performs processing of estimating recommended pressurization force information for each printing apparatus 1 based on the collected operation information and performs processing of transmitting an estimation result to the printing apparatuses 1.

Figure 12:
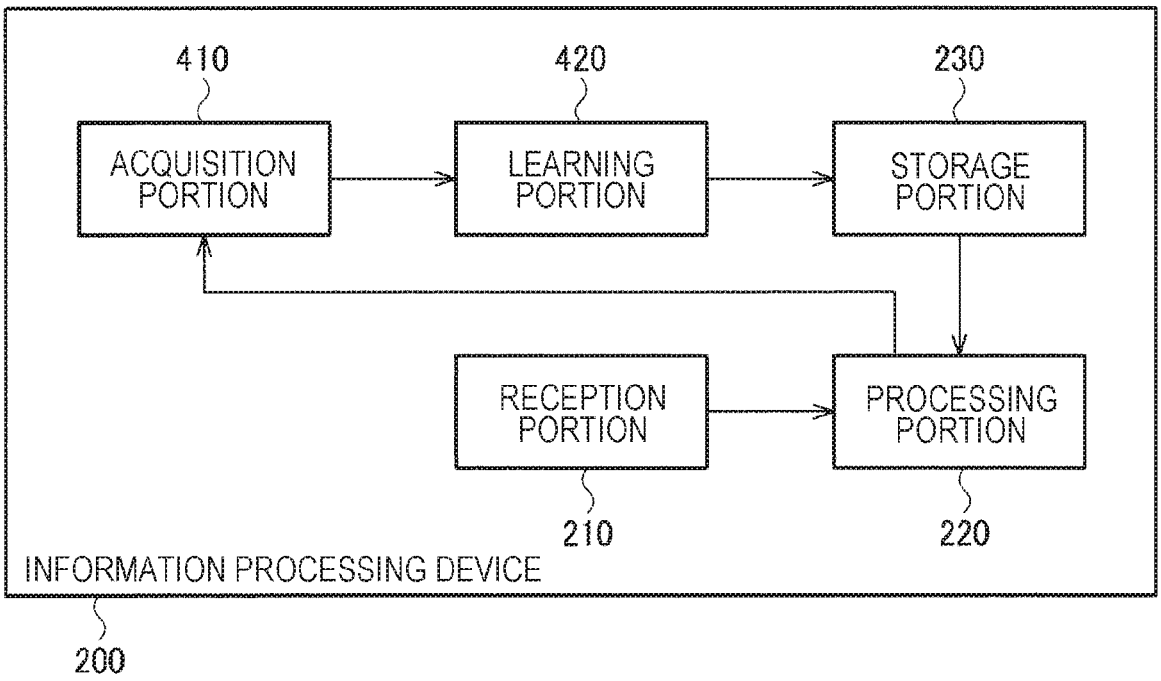
FIG. 12 is another configuration example of the information processing device.

The learning device 400 and the information processing device 200 are separately described above. However, the method of the present embodiment is not limited thereto. For example, as illustrated in FIG. 12, the information processing device 200 may include the acquisition portion 410 acquiring the data set in which the air pressure information, the temperature information, and the pressurization force information are associated, and the learning portion 420 performing machine learning of the condition of the pressurization force with which a determination that an ejection failure does not occur is made, based on the data set. In other words, the information processing device 200 includes a configuration corresponding to the learning device 400 illustrated in FIG. 7 in addition to the configuration in FIG. 11. By doing so, the learning processing and the inference processing can be efficiently executed in the same device.

Figure 13:
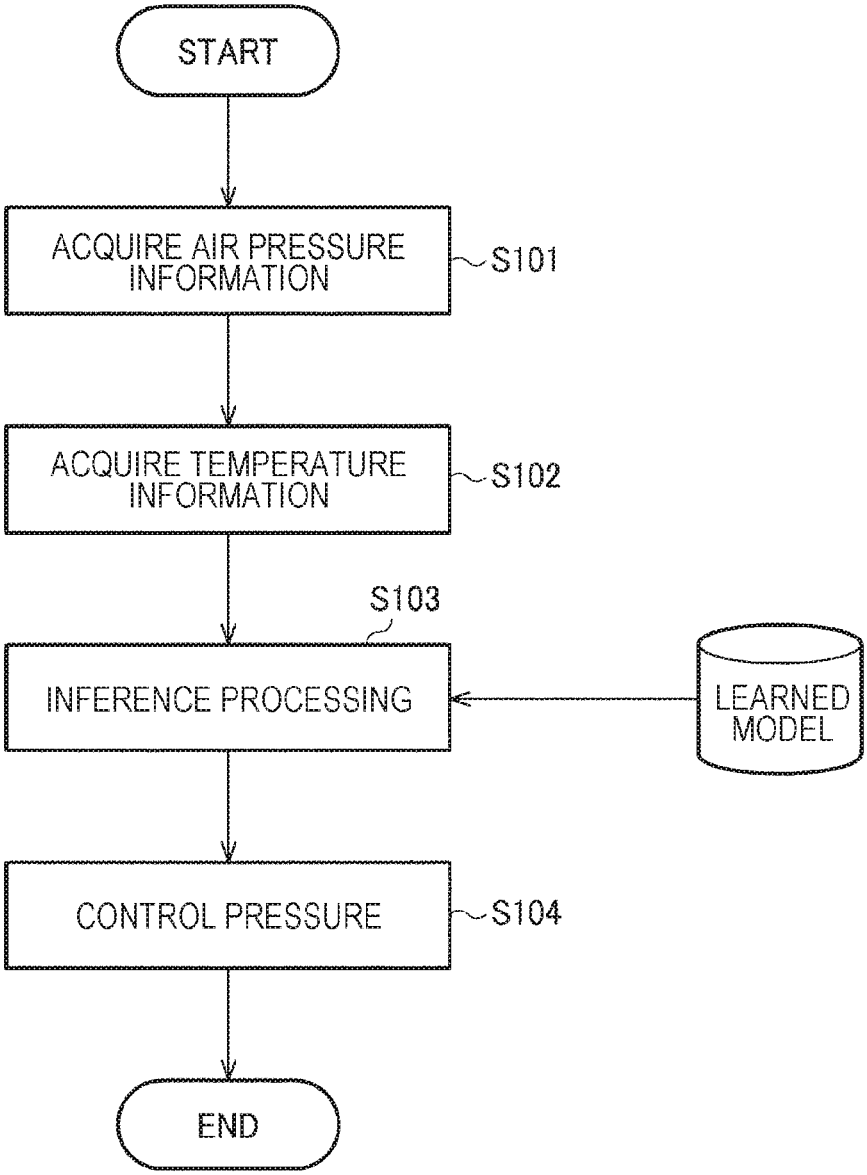
FIG. 13 is a flowchart for describing processing in the information processing device.

The processing performed by the information processing device 200 of the present embodiment may be implemented as an information processing method. The information processing method is a method of acquiring the learned model, receiving the air pressure information and the temperature information at the time of ejecting ink, and controlling the pressurization pump 81 based on the received air pressure information and temperature information and the learned model. As described above, the learned model here is a learned model trained by performing machine learning of the condition of the pressurization force with which a determination that an ejection failure does not occur is made, based on the data set in which the air pressure information in the usage environment of the printing apparatus 1 including the printing head 30, the temperature information in the usage environment, and the pressurization force information about the pressurization pump 81 supplying ink to the printing head 30 are associated. 3.2 Flow of Inference Processing FIG. 13 is a flowchart for describing processing in the information processing device 200. When the processing is started, first, the reception portion 210 receives the air pressure information and the temperature information (S101 and S102).

Next, the processing portion 220 performs processing of estimating the pressurization force information with which a problem such as an ejection failure can be suppressed, based on the acquired air pressure information and temperature information and the learned model stored in the storage portion 230 (S103). In S103, the processing portion 220 may also perform processing of estimating the depressurization force information with which a problem such as an ejection failure can be suppressed.

Next, the processing portion 220 controls the pressurization pump 81 and the depressurization pump 82 based on a result of the inference processing in S103 (S104). That is, the processing portion 220 controls the pressurization pump 81 and the depressurization pump 82 based on the air pressure information and the temperature information acquired by the acquisition portion 410 and the learned model.

The pressurization force of the pressurization pump 81 is increased as the pump motor is operated longer or operated more. However, the amount of increase in pressurization force is decreased along with an elapse of the operation time or an increase in operation amount, and the pressurization force substantially converges to a value corresponding to a capability of the pressurization pump 81. Accordingly, the pressurization force of the pressurization pump 81 has a correspondence relationship with the operation time or the operation amount.

Thus, specifically, in S104, the processing portion 220 controls the operation time or the operation amount of the pressurization pump 81. Similarly, in S104, the processing portion 220 controls the operation time or the operation amount of the depressurization pump 82. For example, the processing portion 220 performs a control for estimating the control information about the pressurization pump 81 as the pressurization force information in S103 and operating the pressurization pump 81 in accordance with the operation time or the operation amount corresponding to the control information. Alternatively, the processing portion 220 estimates a target pressurization amount as the pressurization force information in S103. The processing portion 220 performs a control for sequentially acquiring the value of the pressure detection sensor 94 and operating the pressurization pump 81 in accordance with a time or an amount in which the pressurization force detected by the pressure detection sensor 94 reaches the target pressurization amount. For example, the processing portion 220 performs an ink supply control using the flow passage pump 83 based on the air pressure information, the temperature information, and the learned model. Alternatively, the processing portion 220 performs the ink supply control using the intermediate tank 88 based on the air pressure information, the temperature information, and the learned model.

An example in which estimation of the pressurization force information and the depressurization force information and control of the pressurization pump 81 and the depressurization pump 82 based on the estimated information are in a series of processing is described using FIG. 13. For example, each time a printing job is started, estimation processing for the pressurization force information and the depressurization force information is performed. However, the processing of the present embodiment is not limited thereto. For example, processing in S101 to S103 may be performed when a power supply of the printing apparatus 1 is turned ON, and information estimated in S103 may be continuously used until the power supply is turned OFF. Besides, various modifications can be made to a flow of processing in the present embodiment.

4. Additional Learning

In the present embodiment, a learning stage and an inference stage may be clearly distinguished. For example, the learning processing is performed in advance by a maker or the like of the printing apparatus 1, and the learned model is stored in the memory 103 of the printing apparatus 1 at the time of shipment of the printing apparatus 1. In a stage of using the printing apparatus 1, the stored learned model is steadily used.

However, the method of the present embodiment is not limited thereto. The learning processing of the present embodiment may include initial learning of generating an initial learned model and additional learning of updating the learned model. The initial learned model is, for example, a general-purpose learned model stored in advance in the printing apparatus 1 before shipment as described above. The additional learning is, for example, learning processing for updating the learned model in accordance with a usage situation of individual users.

The additional learning may be executed in the learning device 400, and the learning device 400 may be a device different from the information processing device 200. The information processing device 200 performs processing of acquiring the air pressure information and the temperature information for the inference processing. The air pressure information and the temperature information can be used as a part of the training data in the additional learning. Considering this point, the additional learning may be performed in the information processing device 200. Specifically, the information processing device 200 includes the acquisition portion 410 and the learning portion 420 as illustrated in FIG. 12. The acquisition portion 410 acquires the air pressure information and the temperature information. For example, the acquisition portion 410 acquires information received by the reception portion 210 in S101 and S102 in FIG. 13. The learning portion 420 updates the learned model based on the data set in which the pressurization force information is associated with the air pressure information and the temperature information.

For example, the pressurization force information here may be information obtained based on the ejection result image information or may be information input by the user such as the service technician as described above. By doing so, the training data can be accumulated in the printing apparatus 1 in operation. Additional learning processing after acquisition of the training data is the same as the flow of learning processing described above and thus, will not be described in detail.

As described above, the information processing device of the present embodiment includes the storage portion storing the learned model, the reception portion receiving the air pressure information and the temperature information at the time of ejecting ink, and the processing portion controlling the pressurization pump based on the received air pressure information and temperature information and the learned model. The learned model is a learned model trained by performing machine learning of the condition of the pressurization force with which a determination that an ejection failure does not occur is made, based on the data set in which the air pressure information, the temperature information, and the pressurization force information are associated. The air pressure information is information indicating the air pressure in the usage environment of the printing apparatus including the printing head. The temperature information is information indicating the temperature in the usage environment of the printing apparatus. The pressurization force information is information indicating the pressurization force of the pressurization pump supplying ink to the printing head.

According to the method of the present embodiment, the pressurization pump used for supplying ink can be controlled using the learned model. At this point, a control considering the temperature characteristics such as thickening of ink can be performed using the learned model trained by machine learning based on the data set including the temperature information in addition to the air pressure information.

The data set may include the type information about the pressurization pump supplying ink to the printing head or the type information about the printing apparatus.

By doing so, a control corresponding to a specific configuration such as the pressurization pump or the ink supply unit can be performed.

The data set may include the ejection result image information acquired by capturing the result of ejecting ink to the printing medium from the printing head.

By doing so, a control considering a specific ejection state of ink can be performed.

The processing portion may control the operation time or the operation amount of the pressurization pump.

By doing so, the pressurization pump can be appropriately controlled based on an output of the learned model.

The air pressure information may be calculated based on the altitude information.

By doing so, the air pressure information can be calculated based on the altitude. For example, the pressurization pump can be appropriately controlled when the printing apparatus is used in a highland.

The data set may include the depressurization force information about the depressurization pump sucking ink from the ink tank. The processing portion controls the depressurization pump based on the air pressure information and the temperature information received by the reception portion and the learned model.

By doing so, the depressurization pump used for supplying ink can be controlled using the learned model. At this point, a control considering thickening of ink can be performed using the learned model trained by machine learning based on the data set including the temperature information in addition to the air pressure information.

The processing portion may control the operation time or the operation amount of the depressurization pump.

By doing so, the depressurization pump can be appropriately controlled based on the output of the learned model.

The printing apparatus may include the pressurization pump, the depressurization pump, and the flow passage pump disposed in a flow passage from the ink tank to the printing head. The processing portion performs the ink supply control using the flow passage pump based on the air pressure information, the temperature information, and the learned model.

By doing so, ink in the ink tank can be supplied to the printing head using the flow passage pump.

The printing apparatus may include the intermediate tank in which ink sucked by the depressurization pump is accumulated. The pressurization pump supplies ink to the printing head by pressurizing the intermediate tank. The processing portion performs the ink supply control using the intermediate tank based on the air pressure information, the temperature information, and the learned model.

By doing so, ink in the ink tank can be supplied to the printing head using the intermediate tank.

The learning device of the present embodiment includes the acquisition portion acquiring the data set in which the air pressure information in the usage environment of the printing apparatus including the printing head, the temperature information in the usage environment, and the pressurization force information about the pressurization pump supplying ink to the printing head are associated, and the learning portion performing machine learning of the condition of the pressurization force with which a determination that an ejection failure does not occur is made, based on the acquired data set.

According to the method of the present embodiment, a learning result from which a pressurization force considered appropriate can be estimated can be output in a situation specified using the air pressure information and the temperature information.

The information processing method of the present embodiment is a method of acquiring the learned model, receiving the air pressure information and the temperature information at the time of ejecting ink, and controlling the pressurization pump based on the received air pressure information and temperature information and the learned model. The learned model is trained by performing machine learning of the condition of the pressurization force with which a determination that an ejection failure does not occur is made, based on the data set in which the air pressure information in the usage environment of the printing apparatus including the printing head, the temperature information in the usage environment, and the pressurization force information about the pressurization pump supplying ink to the printing head are associated.

While the present embodiment is described in detail above, those skilled in the art may easily perceive that various modifications can be made without substantially departing from the novelty and the effects of the present embodiment. Accordingly, all of such modification examples fall within the scope of the present disclosure. For example, terms described in the specification or the drawings at least once together with different terms in a broader sense or the same sense can be replaced with the different terms in any part of the specification or the drawings. All combinations of the present embodiment and the modification examples also fall within the scope of the present disclosure. The configurations, operation, and the like of the learning device, the information processing device, and a system including those devices are not limited to the description of the present embodiment and can be subjected to various modifications.

What is claimed is:

1. An information processing device comprising:

a storage portion storing a learned model trained by performing machine learning of a condition of a pressurization force with which a determination that an ejection failure does not occur is made, based on a data set in which air pressure information in a usage environment of a printing apparatus including a printing head, temperature information in the usage environment, and pressurization force information about a pressurization pump supplying ink to the printing head are associated;

a reception portion receiving the air pressure information and the temperature information at a time of ejecting the ink; and a processing portion controlling the pressurization pump based on the received air pressure information and temperature information and the learned model.

2. The information processing device according to claim 1, wherein the data set includes type information about the pressurization pump supplying the ink to the printing head or type information about the printing apparatus.

3. The information processing device according to claim 1, wherein the data set includes ejection result image information acquired by capturing a result of ejecting the ink to a printing medium from the printing head.

4. The information processing device according to claim 1, wherein the processing portion controls an operation time or an operation amount of the pressurization pump.

5. The information processing device according to claim 1, wherein the air pressure information is calculated based on altitude information.

6. The information processing device according to claim 1, wherein the data set includes depressurization force information about a depressurization pump sucking the ink from an ink tank, and the processing portion controls the depressurization pump based on the air pressure information and the temperature information received by the reception portion and the learned model.

7. The information processing device according to claim 6, wherein the processing portion controls an operation time or an operation amount of the depressurization pump.

8. The information processing device according to claim 6, wherein the printing apparatus includes the pressurization pump, the depressurization pump, and a flow passage pump disposed in a flow passage from the ink tank to the printing head, and the processing portion performs an ink supply control using the flow passage pump based on the air pressure information, the temperature information, and the learned model.

9. The information processing device according to claim 6, wherein the printing apparatus includes an intermediate tank in which the ink sucked by the depressurization pump is accumulated, the pressurization pump supplies the ink to the printing head by pressurizing the intermediate tank, and the processing portion performs an ink supply control using the intermediate tank based on the air pressure information, the temperature information, and the learned model.

10. A learning device comprising:

an acquisition portion acquiring a data set in which air pressure information in a usage environment of a printing apparatus including a printing head, temperature information in the usage environment, and pressurization force information about a pressurization pump supplying ink to the printing head are associated; and a learning portion performing machine learning of a condition of a pressurization force with which a determination that an ejection failure does not occur is made, based on the acquired data set.

11. An information processing method comprising:

acquiring a learned model trained by performing machine learning of a condition of a pressurization force with which a determination that an ejection failure does not occur is made, based on a data set in which air pressure information in a usage environment of a printing apparatus including a printing head, temperature information in the usage environment, and pressurization force information about a pressurization pump supplying ink to the printing head are associated;

receiving the air pressure information and the temperature information at a time of ejecting the ink; and controlling the pressurization pump based on the received air pressure information and temperature information and the learned model.

* * * * *